US011290826B2

(12) United States Patent
Crow et al.

(10) Patent No.: US 11,290,826 B2
(45) Date of Patent: Mar. 29, 2022

(54) SEPARATING AND RECOMBINING AUDIO FOR INTELLIGIBILITY AND COMFORT

(71) Applicant: Whisper.ai, Inc., San Francisco, CA (US)

(72) Inventors: Dwight Crow, San Francisco, CA (US); Shlomo Zippel, San Francisco, CA (US); Andrew Song, San Francisco, CA (US); Emmett McQuinn, San Francisco, CA (US); Zachary Rich, San Francisco, CA (US)

(73) Assignee: WHISPER.AI, Inc., San Francisco, CA (US)

( * ) Notice: Subject to any disclaimer, the term of this patent is extended or adjusted under 35 U.S.C. 154(b) by 0 days.

(21) Appl. No.: 16/932,616

(22) Filed: Jul. 17, 2020

(65) Prior Publication Data

US 2021/0021942 A1 Jan. 21, 2021

Related U.S. Application Data

(63) Continuation of application No. 16/264,297, filed on Jan. 31, 2019, now Pat. No. 10,721,571, which is a continuation of application No. PCT/US2018/057418, filed on Oct. 24, 2018.

(60) Provisional application No. 62/576,373, filed on Oct. 24, 2017.

(51) Int. Cl.
*H04R 25/00* (2006.01)

(52) U.S. Cl.
CPC ..... *H04R 25/505* (2013.01); *H04R 25/43* (2013.01); *H04R 2225/43* (2013.01); *H04R 2225/55* (2013.01)

(58) Field of Classification Search
CPC .. H04R 25/505; H04R 25/43; H04R 2225/43; H04R 2225/55; H04R 25/40; G10L 21/028; G10L 21/0272; G10L 21/0316; G10L 25/27; H04S 7/303; H04S 7/304
See application file for complete search history.

(56) References Cited

U.S. PATENT DOCUMENTS 3,750,024 A 7/1973 Dunn et al.
7,295,676 B2 * 11/2007 Chalupper ..... H04R 25/407 381/313
8,538,049 B2 9/2013 Apfel et al.
(Continued)

FOREIGN PATENT DOCUMENTS

CN 103155599 A 6/2013

OTHER PUBLICATIONS

Weile et al., "The VeloxTM Platform," TECH PAPER, 2016, https://www.oticon.com/-/media/oticon-US/main/download-center/white-papers/15555-9940-velox-whitepaper.pdf, 8 pages.
International Preliminary Report on Patentability issued in International Application No. PCT/US2018/050784 dated Mar. 26, 2020, 8 pages.
Office Action issued in Canadian Application No. 3,075,738 dated Apr. 14, 2020, 3 pages.
(Continued)

*Primary Examiner* — Jason R Kurr
(74) *Attorney, Agent, or Firm* — Mauriel Kapouytian Woods LLP; Michael Mauriel; Tzvi Hirshaut

(57) ABSTRACT

Audio enhancement systems, devices, methods, and computer program products are disclosed. In particular embodiments, audio is separated by source at an auxiliary processing device, primary voice presence and/or relevancy per source is determined and used to determine enhancement data that is sent to one or more earpieces and used for enhancing audio at the earpiece. These and other embodiments are disclosed herein.

29 Claims, 6 Drawing Sheets

(56) References Cited

U.S. PATENT DOCUMENTS

| | | | | |
|---|---|---|---|---|
| 8,792,661 | B2 | 7/2014 | Apfel et al. | |
| 9,049,525 | B2 | 6/2015 | Nielsen et al. | |
| 9,384,737 | B2 * | 7/2016 | Lamb | G10L 17/00 |
| 9,961,435 | B1 | 5/2018 | Goyal et al. | |
| 10,433,075 | B2 | 10/2019 | Crow et al. | |
| 10,721,571 | B2 | 7/2020 | Crow et al. | |
| 2009/0043577 | A1 | 2/2009 | Godavarti | |
| 2009/0190774 | A1 | 7/2009 | Wang et al. | |
| 2009/0285422 | A1 | 11/2009 | Kornagel | |
| 2010/0158289 | A1 | 6/2010 | Beck et al. | |
| 2011/0007907 | A1 | 1/2011 | Park et al. | |
| 2011/0237295 | A1 | 9/2011 | Bartkowiak et al. | |
| 2012/0183165 | A1 | 7/2012 | Foo et al. | |
| 2015/0289065 | A1 | 10/2015 | Jensen et al. | |
| 2016/0099008 | A1 | 4/2016 | Barker et al. | |
| 2016/0142820 | A1 | 5/2016 | Kraft et al. | |
| 2016/0360326 | A1 | 12/2016 | Bergmann et al. | |
| 2017/0147281 | A1 | 5/2017 | Klimanis et al. | |
| 2018/0014130 | A1 * | 1/2018 | Lunner | A61F 11/06 |
| 2018/0054683 | A1 | 2/2018 | Pedersen et al. | |
| 2018/0088900 | A1 * | 3/2018 | Glaser | G06F 3/0482 |
| 2020/0204928 | A1 * | 6/2020 | Fichtl | H04R 25/505 |

OTHER PUBLICATIONS

International Search Report and Written Opinion issued in International Application No. PCT/US2018/057418 dated Jan. 31, 2019, 11 pages.

Office Action issued in Chinese Application No. 2018800689699 dated Nov. 9, 2020, 12 pages.

Office Action issued in European Application No. 18 783 604.4 dated Dec. 17, 2020, 5 pages.

McKinney et al., "Acceptable Hearing Aid Delay as a Function of Singal-to-Noise Ratio," 2016, 1 page.

Burwinkel et al., "Acceptable Hearing Aid Throughput Delay For Listeners with Hearing Loss Under Noisy Conditions," Poster session presented at the Annual Scientific and Technology Conference of the American Auditory Society, Scottsdale, AZ., 2016, 1 page.

Office Action issued in European Application No. 18 783 604.4 dated May 6, 2021, 7 pages.

Notification to Grant Patent Right for Invention issued in Chinese Application No. 201880068969.9 dated Jun. 3, 2021, 9 pages.

Office Action issued in European Application No. 18 783 604.4 dated Sep. 20, 2021, 4 pages.

* cited by examiner

SEPARATING AND RECOMBINING AUDIO FOR INTELLIGIBILITY AND COMFORT

CROSS-REFERENCE TO RELATED APPLICATIONS

This application is a continuation of Ser. No. 16/264,297 filed Jan. 31, 2019, which is a continuation of International Application Number PCT/US2018/057418 filed 24 Oct. 2018, which claims the benefit of U.S. Provisional Application No. 62/576,373 filed 24 Oct. 2017. The subject matter of this application is also related to the subject matter of U.S. application Ser. No. 16/129,792 filed on Sep. 12, 2018 and of Provisional Application No. 62/557,468 filed Sep. 12, 2017. The contents of each of these applications referenced above are hereby incorporated by reference herein.

TECHNICAL FIELD

This invention relates generally to the audio field, and more specifically to new and useful methods, systems, devices, and computer program products for audio enhancement.

Figure 1:
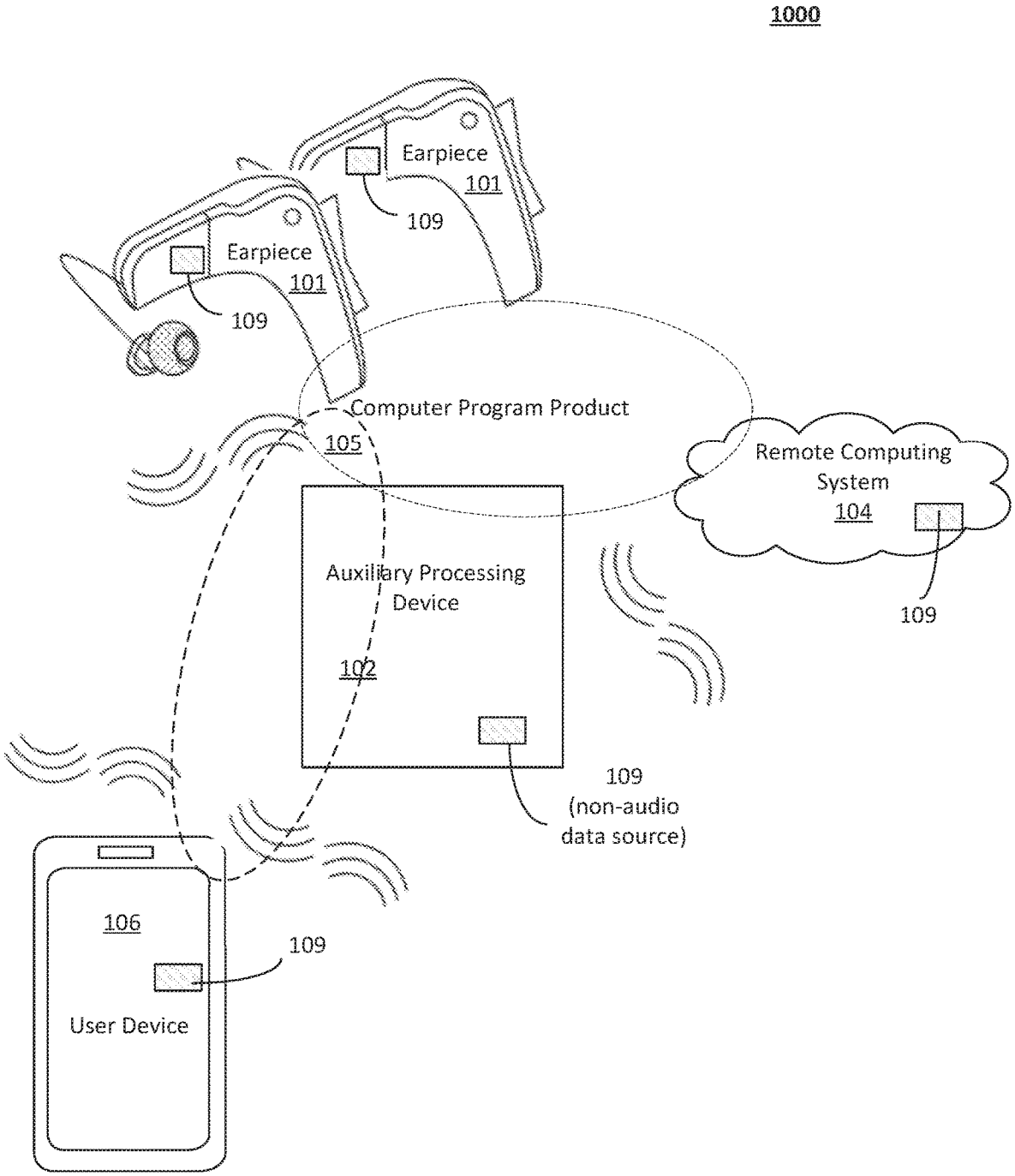
FIG. 1 is a high-level diagram of audio enhancement system 1000 in accordance with one embodiment of the invention.

While the invention is described with reference to the above drawings, the drawings are intended to be illustrative, and other embodiments are consistent with the spirit, and within the scope, of the invention.

DETAILED DESCRIPTION

Hearing aid systems have typically made distinctions between broad categories of sound in a user's environment and then provided processing to optimize hearing for those sound categories. For example, currently available hearing aids typically try to distinguish between general noise in an environment and intelligible sounds such as music and/or voice. Such hearing aids then provide filtering to try to make the intelligible sounds louder relative to the other sounds.

However, in a multi-sound environment, limiting sound distinctions to broad categories falls short in many situations. For example, in a room with several conversations going on, distinction between voice sounds and other sounds is insufficient to enhance the user's ability to listen to a particular person's voice. Moreover, many sounds that are generally undesirable to a user, e.g., the clinking of dishes, are not sufficiently distinct from voice sounds for current hearing aid technologies to filter them out.

By contrast, specifically identifying separate individual sound sources in the vicinity of the user (i.e., hearing aid wearer) offers the possibility of significantly improving audio enhancement. For example, if each individual voice in a conversation can be separately identified in the audio data and, further, if an accurate determination can be made regarding which voice the user is trying to hear, then a hearing aid system can potentially apply more sophisticated filtering to better enhance a primary voice relative to other voices and other sounds in the room.

These tasks—separating individual coherent audio sources, intelligently determining which source the user cares about most, and recombining those sources based on that determination—collectively require much more sophisticated processing than current hearing aids provide.

Embodiments of the invention leverage processing power provided by an auxiliary device to conduct one or more of the following tasks for improving hearing aid audio processing: Separating sounds by individual source, collecting and computing various source parameters and context parameters, using the source parameters and/or context parameters to estimate whether a primary voice source is present and/or infer relevancy of various sources, compute adjusted source volumes based on primary voice and/or other source relevancy estimates and determine and send appropriate filter updates to user earpiece devices. For example, such filter updates may reflect relevance based on the volume of each coherent acoustic source. In some embodiments, algorithms for separating sources, computing source parameters, and determining relevancy are machine-learning algorithms trained by data associated with the user and/or other users. In some embodiments, data is sent from the auxiliary device to a remote computing system (e.g., a cloud-based computing system) to further train algorithms for improved processing. Algorithm updates are sent back to the auxiliary device to apply to processing current audio for separating sources, computing source parameters and contextual parameters, determining presence of a primary voice, and determining relevancy per source.

Hearing aid systems have traditionally conducted audio processing tasks using processing resources located in the earpiece. Because small hearing aids are more comfortable and desirable for the user, relying only on processing and battery resources located in an earpiece limits the amount of processing power available for delivering enhanced-quality low latency audio at the user's ear. For example, one ear-worn system known in the art is the Oticon Opn™. Oticon advertises that the Opn is powered by the Velox™ platform chip and that the chip is capable of performing 1,200 million operations per second (MOPS). See Oticon's Tech Paper 2016: "The Velox™ Platform" by Julie Neel Welle and Rasmus Bach (available at www.oticon.com/support/downloads).

A system not constrained by the size requirements of an earpiece could provide significantly greater processing power. However, the practical requirement for low latency audio processing in a hearing aid has discouraged using processing resources and battery resources remote from the earpiece. A wired connection from hearing aid earpieces to a larger co-processing/auxiliary device supporting low latency audio enhancement is not generally desirable to users and can impede mobility. Although wireless connections to hearing aid earpieces have been used for other purposes (e.g., allowing the earpiece to receive Bluetooth audio streamed from a phone, television, or other media playback device), a wireless connection for purposes of off-loading low latency audio enhancement processing needs from an earpiece to a larger companion device has, to date, been believed to be impractical due to the challenges of delivering, through such a wireless connection, the low latency and reliability necessary for delivering acceptable real-time audio processing. Moreover, the undesirability of fast battery drain at the earpiece combined with the power requirements of traditional wireless transmission impose further challenges for implementing systems that send audio wirelessly from an earpiece to another, larger device for enhanced processing.

Embodiments of the invention address these challenges and provide a low-latency, power-optimized hearing aid system in which target audio data obtained at an earpiece is efficiently transmitted for enhancement processing at an auxiliary processing device (e.g., a secondary device, tertiary device or other device—which might, in some sense, be thought of as a coprocessing device). The auxiliary processing device provides enhanced processing power not available at the earpiece. In particular embodiments, when audio is identified for sending to the auxiliary processing device for enhancement, it—or data representing it—is sent wirelessly to the auxiliary processing device. The auxiliary processing device analyzes the received data (possibly in conjunction with other relevant data such as context data and/or known user preference data) and determines filter parameters (e.g., coefficients) for optimally enhancing the audio. Preferably, rather than sending back enhanced audio from the auxiliary device over the wireless link to the earpiece, an embodiment of the invention sends audio filter parameters back to the earpiece. Then, processing resources at the earpiece apply the received filter parameters to a filter at the earpiece to filter the target audio and produce enhanced audio played by the earpiece for the user. These and other techniques allow the earpiece to effectively leverage the processing power of a larger device to which it is wirelessly connected to better enhance audio received at the earpiece and play it for the user on without delay that is noticeable by typical users. In some embodiments, the additional leveraged processing power capacity accessible at the wirelessly connected auxiliary processing unit is at least ten times greater than provided at current earpieces such as the above referenced Oticon device. In some embodiments, it is at least 100 times greater.

In some embodiments, trigger conditions are determined based on one or more detected audio parameters and/or other parameters. When a trigger condition is determined to have occurred, target audio is sent to the auxiliary processing device to be processed for determining parameters for enhancement. In one embodiment, while the trigger condition is in effect, target audio (or derived data representing target audio) is sent at intervals of 40 milliseconds (ms) or less. In another embodiment, it is sent at intervals of 20 ms or less. In another embodiment, it is sent at intervals of less than 4 ms.

In some embodiments, audio data sent wirelessly from the earpiece to the auxiliary unit is sent in batches of 1 kilobyte (kb) or less. In some embodiments, it is sent in batches of 512 bytes or less. In some embodiments, it is sent in batches of 256 bytes or less. In some embodiments, it is sent in batches of 128 bytes or less. In some embodiments, it is sent in batches of 32 bytes or less. In some embodiments, filter parameter data sent wirelessly from the auxiliary unit is sent in batches of 1 kilobyte (kb) or less. In some embodiments, it is sent in batches of 512 bytes or less. In some embodiments, it is sent in batches of 256 bytes or less. In some embodiments, it is sent in batches of 128 bytes or less. In some embodiments, it is sent in batches of 32 bytes or less.

FIG. 1 is a high-level diagram of an audio enhancement system 1000 in accordance with one embodiment of the invention. System 1000 comprises earpieces 101 (for, respectively, left and right ears), auxiliary processing device 102, remote computing system 104, and user device 106. The illustrated components are configured by computer program product 105 to perform processing in accordance with various embodiments of the invention. Computer program product 105 may be provided in a transitory or non-transitory computer readable medium; however, in a particular embodiment, it is provided in a non-transitory computer readable medium, e.g., persistent (i.e., non-volatile) storage, volatile memory (e.g., random access memory), or various other well-known non-transitory computer readable mediums. In the illustrated embodiment, computer program product 105 in fact represents computer program products or computer program product portions configured for execution on, respectively, earpieces 101, auxiliary processing device 102, remote computing system 104, and user device 106.

Earpieces 101 comprise audio microphones (not separately shown) to capture audio data in the vicinity of a user. The various components of system 1000 also comprise non-audio data sources 109 which include one or more of the following sensors or other data sources: accelerometers, gyroscopes, location sensors, user input interfaces, temperature, wind, or other weather information sources, time information sources, user profile data sources, data regarding other hearing aid users, directional data sensors, optical sensors, data regarding current events or conditions at a location of a user of system 1000, Bluetooth sources, Wi-Fi sources, historical data sources, etc.

The embodiment of system 1000 is described in further detail in the context of FIGS. 2-5, but generally operates as follows. Audio data in the vicinity of the user is captured and pre-processed for quality enhancement (e.g., by applying dynamic range compression to map the audio into a preferred volume range) and to determine whether to send it (or portions of it) to auxiliary processing device 102. Earpieces 102 selectively send audio data wirelessly from earpieces 101 to auxiliary processing device 102. Auxiliary processing device 102 also receives non-audio data from one or more non-audio data sources 109. Auxiliary processing device 102 processes the received audio data and non-audio data to identify/separate individual audio sources in the vicinity of the user, collect and compute source parameters for each source, collect and compute contextual parameters, and use the source and contextual parameters to estimate relevance of each audio source to the user. Auxiliary processing device 102 is also adapted to receive user input data (e.g., volume adjustments, responses to preference prompts regarding particular sources or to other inquiries) provided at one or more of user device 106, earpiece 101, auxiliary processing device 102, and remote computing system 104. Received user input is usable, among other things, to incorporate into a determination of relevance of identified audio sources to a user.

Once the relevancy of audio sources is estimated, auxiliary processing device 102 uses those estimates to assign volume weights to the various audio sources and then send appropriate filter updates wirelessly to earpieces 101 for use in playing current audio to the user. Preferably, auxiliary device 102 uses trained algorithms (e.g., machine-learning algorithms) to perform some of its described processing. In some embodiments, data regarding source separation, source parameters, contextual parameters, relevancy estimates, and audio received are sent from auxiliary processing device 102 to remote computing system 104. In such embodiments, remote computing system 104 conducts further training and refinement of applicable machine-learning algorithms and sends any algorithm updates or new algorithms to auxiliary processing device 102.

The processing that occurs, in one particular embodiment, at earpieces 101, auxiliary processing device 102, and remote computing system 104 will now be described in further detail in the context of FIGS. 2-5. It should be noted that, in the primary embodiment illustrated herein, auxiliary processing device 102 is shown as a separate device from user device 106. However in alternative embodiments, the features of an auxiliary processing device as described herein might be incorporated into a user device such as a smartphone or other mobile device without necessarily departing from the spirit and scope of the invention. Moreover, while the primary embodiment described herein associates certain processing with particular components of system 1000, the location for various processing functions and the divisions of labor between the various components might vary in particular embodiments.

Figure 2:
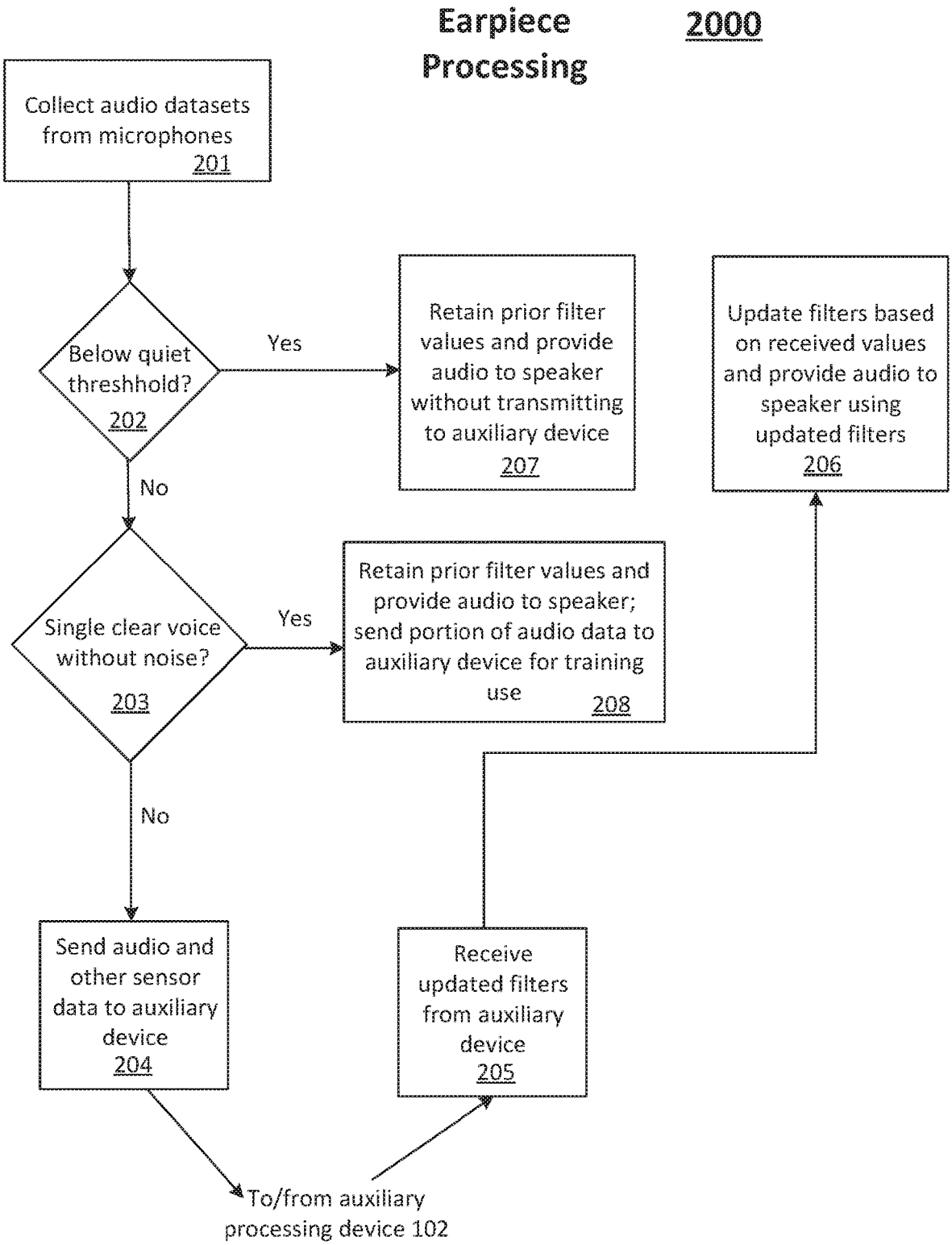
FIG. 2 is a flow diagram illustrating processing conducted by earpieces 101 of FIG. 1 in accordance with a particular embodiment of the invention.

FIG. 2 is a flow diagram illustrating processing 2000 conducted by earpieces 101 in accordance with a particular embodiment of the invention.

Step 201 collects audio datasets from microphones at earpieces 101. Collected audio datasets, in a particular embodiment, can include audio data as well as additional data related to, for example, directional and spatial information (e.g., when multiple microphones are used) about the audio data. Other sensor data (e.g., from accelerometers/inertial sensors) or other data such as user volume control data, might be available from sensors at earpieces 101, and that data is also sent, where available and potentially relevant, to auxiliary processing device 102.

Step 202 determines if the collected audio data is below a quietness threshold such that there is likely no relevant content, or too little potentially relevant content, to merit enhancement processing. If the result of step 202 is yes, then processing proceeds to step 207, prior (current, but not updated) filter values are maintained as the current filter values, and the audio is provided through the relevant speaker without being sent to auxiliary device 102 for enhancement processing. If the result of step 202 is no, then step 203 determines whether there is likely a single, clear voice in the audio data such that further enhancement processing at auxiliary device 102 is unnecessary. If the result of step 203 is yes, then processing proceeds to step 208, prior filter values are maintained, and the audio is provided to the earpiece speaker. Step 208 also sends selected portions of the relevant audio data to auxiliary processing device 102 so that it can be used for machine-learning/training purposes.

If the result of step 203 is no, then step 204 sends audio and, if applicable, data from non-audio sensors to auxiliary device 102 for enhancement processing. Step 205 receives updated filters from auxiliary device 102 and then step 206 applies those filter updates and uses updated filters to provide enhanced audio at the earpiece speaker.

Figure 3:
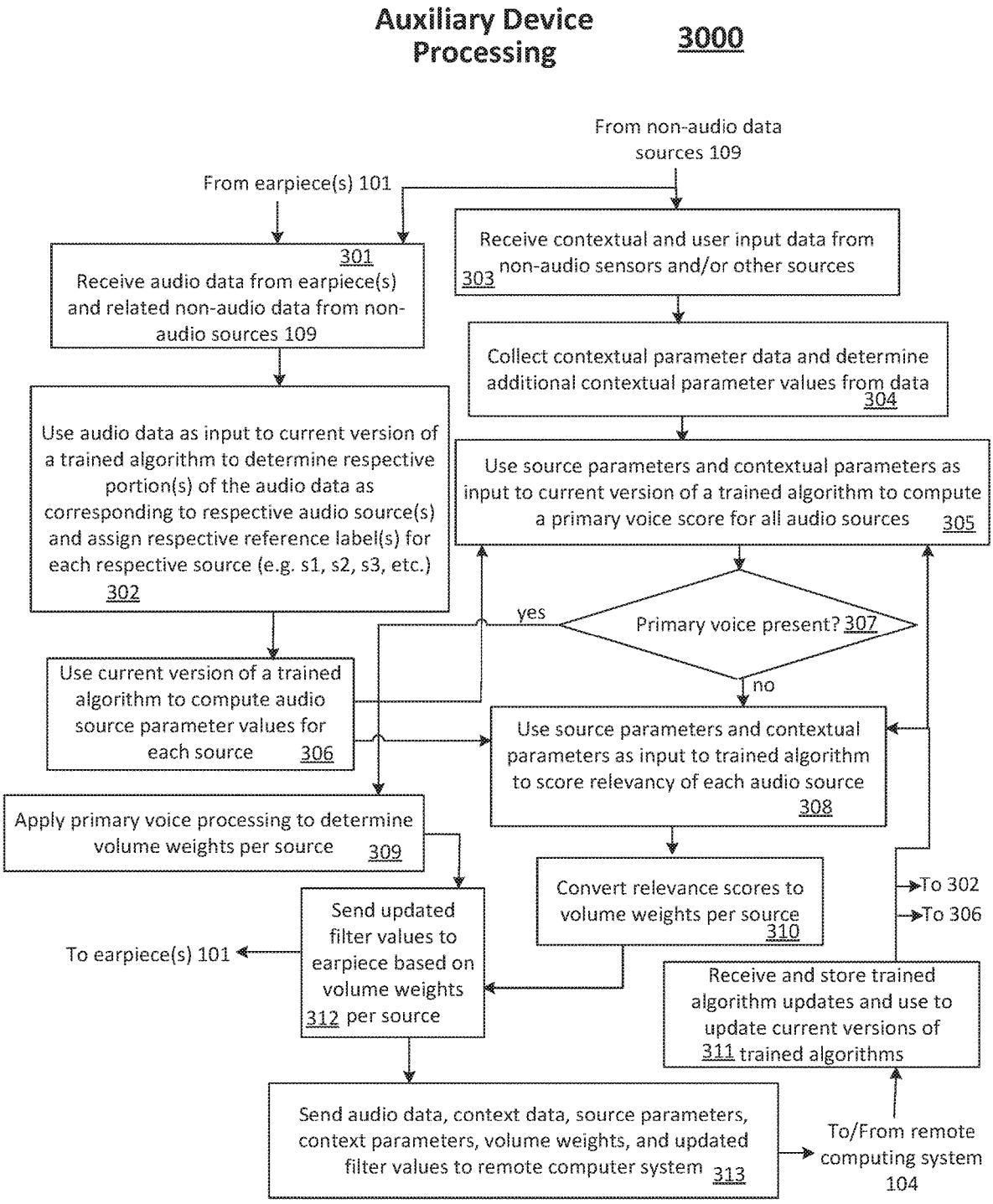
FIG. 3 is a flow diagram illustrating processing conducted by auxiliary device 102 of FIG. 1 in accordance with a particular embodiment of the invention.

FIG. 3 illustrates auxiliary device processing 3000 carried out, in a particular embodiment, by auxiliary device 102. Step 301 receives audio data from earpiece (or earpieces) 101. Received audio data can include, in addition to audio signals themselves, other data regarding the particular audio signals including, but not necessarily limited to, directional and spatial information associated with the data. Step 301 also receives or otherwise accesses data from non-audio data sources 109 that is potentially relevant to separating audio sources and computing source parameters. In various embodiments, this data can include, but is not necessarily limited to data related to one or more of user location, head movement, body movement, biometric data (e.g. pulse, blood pressure, oxygen level, temperature, etc.) optical data, location data, environmental data including weather or other data, event data, user preferences, user interface actions, medically specified user hearing parameters, user social network information, historical data, and other data.

Step 302 uses audio data along with potentially relevant non-audio data as input to one or more trained algorithms (e.g., a neural network, a support vector machine, or another machine-learning processing structure) that are used to determine respective portions of the audio data as corresponding to respective coherent audio sources. Source separation in this context simply means that the audio data is used to identify with a reasonable probability the major distinct sources of audio in an environment, and to decompose an audio stream into the separate audio streams which originated from each audio source. In one embodiment, previously known source separation techniques are applied. In another embodiment, various novel data inputs or novel combinations of data inputs are used to train algorithms for improved source separation. In one embodiment, for example, a speech recognition module is applied to recognize words in audio data and the words meanings and sequences are used to enhance source separation processing to obtain initial separation results or as an added verification on obtained results. As distinct coherent sources are identified as such in the audio data, they are assigned reference labels (e.g., s1, s2, s3) which might simply be numbers or other alphanumeric labels etc. so that those sources can later be distinguished in further processing.

Step 306 uses a current version of a trained algorithm to compute audio source parameter values for each source. For example, the audio source parameters can be computed directly from audio, contextual parameters, other source parameters, or any combination thereof. Some source parameters are directly obtained from the audio data corresponding to that source. For example, volume, doppler shift (which is used to show speed of a source relative to the user's earpiece microphone—or speed of user's earpiece microphone relative to a source), pitch, and various speech-like or non-speech like known characteristics in the audio signal. However, various other data can be used as source parameters and/or can be used to compute particular source parameters. In one embodiment, the following source parameters, shown in TABLE I are obtained (i.e., collected or computed from collected data):

TABLE I

| Parameter Name | Description |
|---|---|
| Location | Distance and angle from user |
| Velocity | Change in relative position of source from user per/unit time |
| Novelty_at_moment | Amount of immediately preceding time sound from source has been continuously happening |
| Historical_novelty | Fraction of day or other time unit that this sounds happens on average (over some historical time period) |
| Sound_class | What type/category of sound is this (e.g., person, car, dog, alarm, tree rustling, music, etc.) |

TABLE I-continued

| Parameter Name | Description |
|---|---|
| Sound_instance_non-person | A particular identified entity within the class other than a human |
| Sound_instance_person | Identity of particular person who is the source (treated separately from non-person instances given importance) |
| Historical_attention_class | Attention score per class (i.e., for the class to which the identified source belongs) |
| Historical_attention_instance | Attention score per instance (i.e., for the particular identified source) |
| Recognized_words_source | Sequences of one or more words with recognized meaning and further recognized as coming from the source |
| Recognized_words_user | Sequences of one or more words with recognized meaning and further recognized as coming from the user |

"Attention" as referenced above is a measure determined, in one embodiment, based on historical change in the user's speech, head position, or body movement that appears causally associated with a sound class or instance. In one embodiment, attention is scored as combination of magnitude of change precipitated and consistency of apparent causal relationship.

Regarding semantic parameters (e.g., "recognized_words_user" or "recognized_words_source"), various combinations of words can assist in identifying a source and/or scoring the relevance of a source. Particular words such a salutations ("hi!") or salutations and names ("hi Bob!") spoken by the user, for example (or by the source) could make clear that a user is paying attention to a particular source.

Other parameters can be determined and used. For example, logical conversation parameters can be particularly helpful. One example of a logical conversation parameter includes a conversational overlap parameter determine from, for example, an observation based on collected data that the user (earpiece wearer) and a first source, Source 1 are taking turns speaking and to not speak over each other, but a second source, Source 2 appears to talk over both of them. Another example is a user's head movements relative to multiple speakers. This might be determined, for example, from observations based on collected data that the wearer's head responds by turning to Sources 1 and 2 when they speak, but does not seem to respond to a third source, Source 3.

Many other source parameters can be computed in particular embodiments.

Step 304 collects contextual parameters from collected data and computes additional contextual parameters. Examples include, in particular embodiments, inertial movement, GPS, Wi-Fi signals, time of day, historical user activities, etc. Additional contextual parameters might be computed based on parameters already collected or computed. One example might be an estimate of the user's overall environment, e.g. is the user in a restaurant, hiking, at the workplace, etc. Another example might be an estimate of the user's activity, e.g., is the user (wearer) in conversation, walking, running, sitting, reading, etc.

Step 305 uses source parameters and contextual parameters as input to current version of a trained algorithm to compute a primary voice score for all audio sources. Step 307 determines, based on the primary voice scores for each source, whether there is a primary voice source present (and its identity) or not. If the result of 307 is no, processing proceeds to step 308. If the result of step 307 is yes, then processing proceeds to step 309 to perform primary voice processing to determine volume weights per source. Primary voice processing is further described in the context of FIG. 4.

Step 308 uses source parameters and contextual parameters as input to a trained algorithm to score relevancy of each audio source. Step 310 converts relevancy scores to volume weights per source. Once volume weights per source are computed, either at step 309 or at steps 308 and 310, step 312 uses the volume weights per source to update filters and send the updated filters to earpieces 101.

Step 313 sends various audio and other data collected, along with computed source separation results, source parameters, contextual parameters, estimates made, user reactions measured or collected via user input, to remote computing system 104 to be used as training data for improving the utilized trained algorithms. In some embodiments, data is selectively sent by step 313 periodically via wireless communication in small batches. In some embodiments, or in versions of a primary embodiment, data is sent in larger batches periodically when auxiliary processing device 102 has a hardline connection to a network and/or is plugged into a power source. Step 311 periodically receives updates to trained algorithms. This could include simply updated coefficients used at nodes of an existing neural network structure or it could also or alternatively includes updates to the underlying structure or type of algorithm used. In the illustrated embodiment, updates received at step 311 are provided for use by steps 305, 302, and 306.

Figure 4:
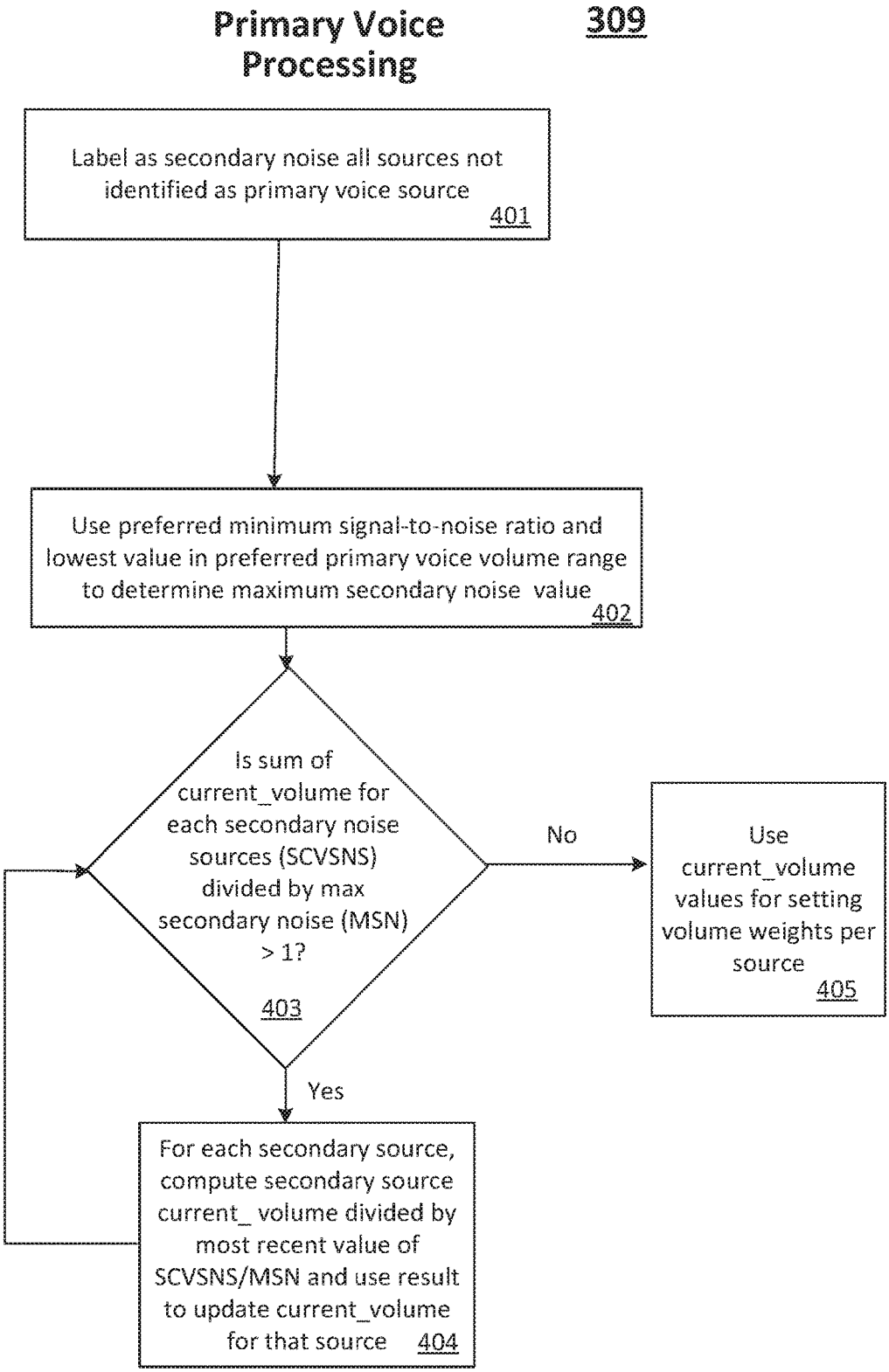
FIG. 4 is a flow diagram illustrating further detail of primary voice processing conducted by step 309 of FIG. 3.

FIG. 4 illustrates primary voice processing 309 of FIG. 3 in further detail. The purpose of primary voice processing 309 is to address an especially important hearing scenario in which a particular voice source is determined to be a single source to which the user it trying to attend (listen). When that scenarios is recognized by system 1000 as occurring, then processing 309 is used, in a particular embodiment, to enhance the audio to maximize the user's ability to hear what is being said by the primary voice source.

Step 401 categorizes as secondary noise, all sources not identified by step 307 of FIG. 3 as the primary voice source. Step 402 takes the preferred minimum signal-to-noise ratio of the user and the lowest value in the primary voice volume range to determine a maximum secondary noise volume. "Signal" is taken as the primary voice volume and "noise" is the sum of secondary noise source volumes. In some embodiments, the preferred minimum signal-to-noise ratio is determined based on user preferences. In some embodiments, it is a medically determined value for the user based on audiological testing.

Step 403 determine whether the sum of current_volume values for all secondary noise sources (SCVSNS) divided by the maximum secondary noise value (MSN) determined at step 402 is greater than 1. If the result of step 403 is yes, then, for each secondary source, step 404 computes the value of current_volume divided by the most recent value of SCVSNS/MSN and uses the result to update the current_volume value for that source. Processing then returns to step 403 using updated current_volumes for each source. Then step 405 uses the most recent current_volume values to set volume weights per source.

Figure 5:
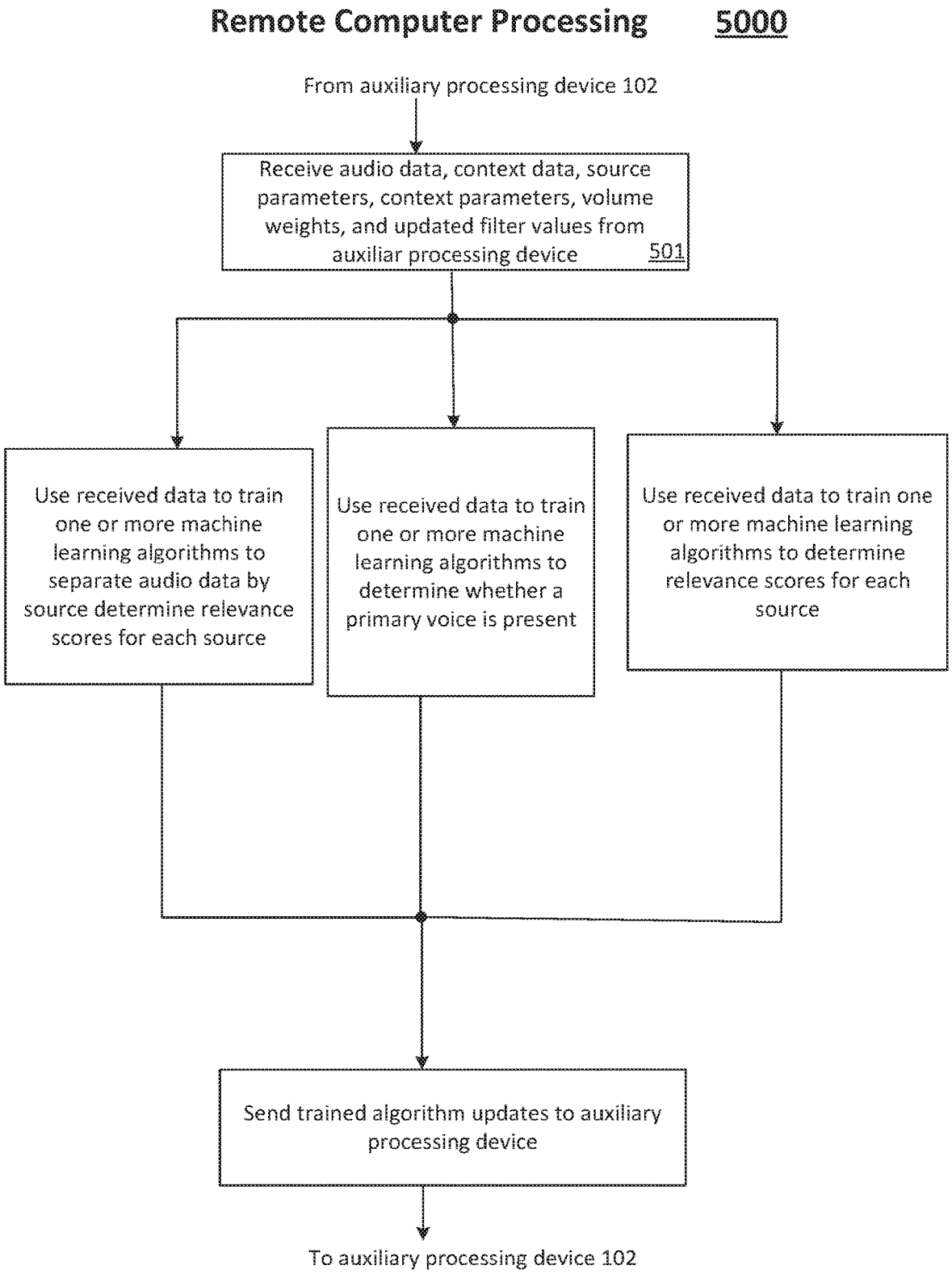
FIG. 5 is a flow diagram illustrating processing conducted by remote computing system of FIG. 1 in accordance with a particular embodiment of the invention.

FIG. 5 is a flow diagram illustrating processing carried out at remote computing system 104 of FIG. 1. Step 501 receives audio data and non-audio data collected by and/or computed at auxiliary processing unit 102. In the illustrated embodiment, this includes various determinations made by processing 3000 of FIG. 3 and subsequent data including user reaction data obtained (e.g., head movements, words spoken, body movement, user input, volume adjustments, etc.) that might be used to assess the accuracy of determinations made by processing 3000 of FIG. 3.

Remote computing system uses the data received to further train and improve algorithms used by processing 3000 of FIG. 3. Step 502 uses received data to train one or more machine-learning algorithms to separate audio by source. Step 503 uses received data to train one ore more machine learning algorithms to determine whether a primary voice is present (including determining primary voice scores for sources and determining appropriate thresholds for primary voice scores (or relative primary voice scores) to determine that a primary voice is present. Step 504 uses received data to train one or more machine learning algorithms to determine relevance scores for each source.

Step 506 sends appropriate trained algorithm updates to auxiliary processing device 102 to improve the initial estimates performed by relevant processing steps carried out by auxiliary processing device 102. In some embodiments, this takes the form of updated coefficients for nodes associated with trained algorithms used by processing 3000. In other embodiments, this also takes the form of adding or removing parameters and/or modifying the underlying structure of machine-learning algorithms used by processing 3000 at auxiliary device 102.

Examples of some particular inference and feedback mechanisms used by embodiments of processing 5000 to improve relevant predictions include one or more of the following. For primary voice, predict if user responds after predicted primary voice speaks by exhibiting responsive behaviors (e.g., looking at primary voice, responding to primary voice, etc.). Predict attention based on user response for any acoustic source and determine if predicted relevance score matches the predicted attention. Predict whether user will turn audio volume up/down. If up/down, something in mix was not high enough/too high estimate of relevance. Train separation by combining clear single voice audio with background noise, then learning to separate them.

Figure 6:
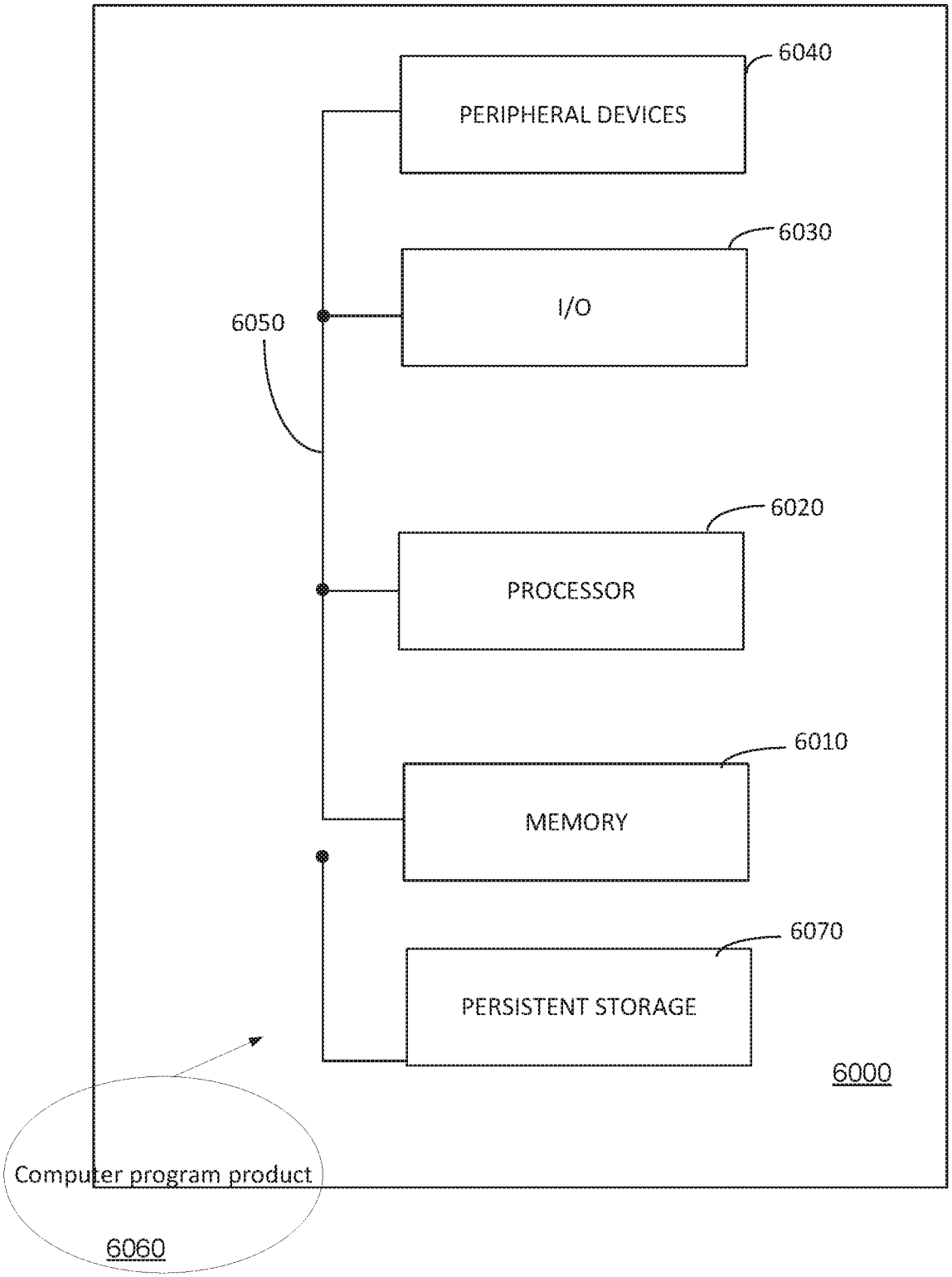
FIG. 6 shows a structure of computing device that, in some embodiments, can be used to implement on or more system components in FIG. 1.

FIG. 6 shows an example of a computer system 6000 (one or more of which may provide one or more the components of system 1000 of FIG. 1, including earpieces 101, auxiliary processing device 102, user device 103, and/or computers in remote computing system 104 that may be used to execute instruction code contained in a computer program product 6060 in accordance with an embodiment of the present invention. Computer program product 6060 comprises executable code in an electronically readable medium that may instruct one or more computers such as computer system 6000 to perform processing that accomplishes the exemplary method steps performed by the embodiments referenced herein. The electronically readable medium may be any non-transitory medium that stores information electronically and may be accessed locally or remotely, for example via a network connection. In alternative embodiments, the medium may be transitory. The medium may include a plurality of geographically dispersed media each configured to store different parts of the executable code at different locations and/or at different times. The executable instruction code in an electronically readable medium directs the illustrated computer system 6000 to carry out various exemplary tasks described herein. The executable code for directing the carrying out of tasks described herein would be typically realized in software. However, it will be appreciated by those skilled in the art, that computers or other electronic devices might utilize code realized in hardware to perform many or all of the identified tasks without departing from the present invention. Those skilled in the art will understand that many variations on executable code may be found that implement exemplary methods within the spirit and the scope of the present invention.

The code or a copy of the code contained in computer program product 6060 may reside in one or more storage persistent media (not separately shown) communicatively coupled to system 6000 for loading and storage in persistent storage device 6070 and/or memory 6010 for execution by processor 6020. Computer system 6000 also includes I/O subsystem 6030 and peripheral devices 6040. I/O subsystem 6030, peripheral devices 6040, processor 6020, memory 6010, and persistent storage device 6060 are coupled via bus 6050. Like persistent storage device 6070 and any other persistent storage that might contain computer program product 6060, memory 6010 is a non-transitory media (even if implemented as a typical volatile computer memory device). Moreover, those skilled in the art will appreciate that in addition to storing computer program product 6060 for carrying out processing described herein, memory 6010 and/or persistent storage device 6060 may be configured to store the various data elements referenced and illustrated herein.

Those skilled in the art will appreciate computer system 6000 illustrates just one example of a system in which a computer program product in accordance with an embodiment of the present invention may be implemented. To cite but one example of an alternative embodiment, execution of instructions contained in a computer program product in accordance with an embodiment of the present invention may be distributed over multiple computers, such as, for example, over the computers of a distributed computing network.

One skilled in the art will recognize that an implementation of an actual computer or computer system may have other structures and may contain other components as well, and that FIG. 6 is a high level representation of some of the components of such a computer for illustrative purposes.

Additional Embodiments and Variations Thereof

Some embodiments of the invention provide a method for improving audio recombination for enhanced audio playback for a user can include: collecting an audio dataset (e.g., spatial audio dataset, etc.) corresponding to a set of audio sensors (e.g., directional microphones of one or more earpieces); determining acoustic source parameters (e.g., describing characteristics of acoustic sources, etc.) for acoustic sources (e.g., coherent, semantic groupings of audio, such as groupings generated based on characteristics associated with human perception of audio; point sources of audio; etc.) based on the audio dataset; and providing recombined audio to the user (e.g., enhanced audio personalized to the user and/or associated contextual environment) based on the acoustic source parameters (e.g., providing recombined audio generated according to foreground and/or background parameters derived from the acoustic source parameters). Additionally or alternatively, some embodiments can include: collecting a contextual dataset; handling recombination-related conditions (e.g., faults associated with determination of acoustic source parameters, recombination parameters, and/or other suitable data); and/or any other suitable processes.

In a specific example, a method according to some embodiments can include: collecting a spatial audio dataset from a plurality of directional microphones corresponding to one or more earpieces worn proximal a head region of a user (e.g., a user in conversation with one or more individuals); collecting a contextual dataset from supplementary sensors (e.g., motion sensors, location sensors, optical sensors, etc.) of the one or more earpieces and/or other user devices (e.g., smartphone, etc.); determining acoustic source parameters including at least one of source type (e.g., voice, vehicle, music, etc.), location, novelty, identity, and contextual environment, based on the spatial audio dataset and the contextual dataset; determining foreground parameters and background parameters (and/or other recombination parameters) based on the acoustic source parameters; and providing recombined audio (e.g., enhanced, combined foreground and background audio signals; incorporating user feedback, automatic environment cues, user settings, audio professional settings; etc.) to the user according to the foreground and background parameters.

Some embodiments of a method and/or system can function to improve audio playback at a hearing aid system through improved audio recombination tailored to the user, contextual environment, and/or other suitable entities.

Data described herein (e.g., audio data, contextual data, other recombination-related data, acoustic source parameters, recombination parameters, audio signals, etc.) can be associated with any suitable temporal indicators (e.g., seconds, minutes, hours, days, weeks, etc.) including one or more: temporal indicators indicating when the data was collected (e.g., sampled at microphones; etc.), determined, transmitted, received (e.g., received at a auxiliary system; etc.), and/or otherwise processed; temporal indicators providing context to content described by the data, such as temporal indicators indicating the time of updates for acoustic source parameters and/or recombination parameters (e.g., in response to analyzing updated audio and/or contextual data); changes in temporal indicators (e.g., latency between collecting the audio dataset and providing the recombined audio; data over time; change in data; data patterns; data trends; data extrapolation and/or other prediction; etc.); and/or any other suitable indicators related to time.

Additionally or alternatively, parameters, metrics, inputs, outputs, and/or other suitable data can be associated with value types including: scores (e.g., an acoustic source parameter of a novelty score assigned to audio data from an audio dataset; etc.), binary values, classifications (e.g., acoustic source type; etc.), confidence levels, values along a spectrum, and/or any other suitable types of values. Any suitable data described herein can be used as inputs (e.g., for models described herein), generated as outputs (e.g., of models), and/or manipulated in any suitable manner for any suitable components.

Some embodiments can be performed asynchronously (e.g., sequentially), concurrently (e.g., providing recombined audio derived from a first dataset while determining acoustic source parameters and/or recombination parameters for a second audio dataset, and/or while collecting a third audio dataset; etc.), in temporal relation to a trigger condition (e.g., updating parameters in response to user feedback; selecting a subset of target audio, from an audio dataset, for escalated enhancement through acoustic source-based separation and recombination, such as in response to detecting satisfaction of escalation conditions based on a contextual dataset and/or audio characteristics of the target audio; etc.), and/or in any other suitable order at any suitable time and frequency by and/or using one or more instances of the system, elements, and/or entities described herein.

A system according to some embodiments (e.g., hearing aid system) can include one or more earpieces and auxiliary processing systems. Additionally or alternatively, in some embodiments, a system can include one or more: remote computing systems; remote sensors (e.g., remote audio sensors; remote motion sensors; etc.); charging stations (e.g., including wireless communication modules for transmitting audio data, parameters, user feedback, and/or other suitable data to a remote computing system; etc.); and/or any other suitable components. In some embodiments, the components of a system and/or other suitable components can be physically and/or logically integrated in any manner (e.g., with any suitable distributions of functionality across the components; etc.) in association with performing portions of a method. For example, earpieces and/or auxiliary processing systems can perform any suitable portions of a method according to some embodiments. In a specific example, according to some embodiments, an earpiece can perform elements of a method where collection and analysis of collected audio datasets and/or contextual datasets occur at an earpiece for provision of recombined audio at the earpiece. In another specific example, functionality associated with a method according to some embodiments may be distributed across one or more earpieces and auxiliary processing systems, such as where the earpiece transmits audio data (e.g., a selected subset of audio data, etc.) to an auxiliary system for processing and recombination, where recombined audio and/or recombination parameters (e.g., fractional filters usable by the earpiece for recombination; foreground and/or background parameters, etc.) can be transmitted from the auxiliary system to the earpiece for facilitating enhanced audio playback. However, methods and systems according to some embodiments can be configured in any suitable manner.

Some embodiments include: collecting an audio dataset corresponding to a set of audio sensors, which can function to receive a dataset including audio data for separation and recombination. Audio datasets may be sampled at one or more microphones (e.g., omnidirectional, cardioid, supercardioid, hypercardioid subcardioid, bidirectional, and/or other suitable types of microphones and/or other suitable types of audio sensors, etc.) of one or more earpieces, but can be sampled at any suitable components (e.g., auxiliary systems, remote microphones, telecoils, earpieces associated with other users, user devices such as smartphones, etc.) at any suitable sampling rate (e.g., fixed sampling rate; dynamically modified sampling rate based on contextual datasets, audio-related parameters determined by the auxiliary system; adjustable sampling rates, such as for audio adjustment prior to providing the recombined audio; etc.).

In some embodiments, variations can include collecting audio data at one or more earpieces (e.g., using a plurality of microphones; using a directional microphone configuration; using multiple ports of a microphone in a directional microphone configuration, etc.), where the collected audio data can be associated with an overlapping temporal indicator (e.g., sampled during the same time period). For example, some embodiments can include collecting an audio dataset from a two-unit omnidirectional microphone system (e.g., including two earpieces, each including two microphones, etc.). In another example, audio datasets collected at non-earpiece components can be collected and transmitted to an earpiece, auxiliary system, remote computing system, and/or other suitable component for processing (e.g., for generating and/or updating models; for processing in combination with audio datasets collected at the earpiece for determining acoustic source parameters, recombination parameters and/or other suitable data; for inclusion in the recombination process, such as for adding contextual audio relevant to the user and or environment; etc.). However, collecting and/or processing multiple audio datasets can be performed in any suitable manner.

In some embodiments, in another variation, a method can include selecting a subset of sensors from a set of sensors of one or more earpieces to collect data (e.g., audio data and/or contextual data, etc.). For example, in response to detecting a state of charge of an earpiece below a threshold, a method can include ceasing contextual data collection at supplementary sensors (e.g., motion sensors) of the earpiece. In another example, a method can include collecting audio data at each audio sensor of the earpieces; and collecting contextual data at a subset of supplementary sensors of the earpiece (e.g., collecting contextual data at a single earpiece in response to detecting a pair of earpieces worn by the user; etc.). In another example, a method can include escalating data collection in response to determination of acoustic source parameters, recombination parameters, and/or other data satisfying a condition (e.g., determining a novelty score exceeding a threshold; identifying a conversation including voices of individuals with strong social connections to the user, where the social connections can be indicated by the user, social network data, historic audio data; and/or other suitable data; determining background parameter values indicating a high level of background audio; etc.). However, selective data collection can be performed in any suitable manner.

In some embodiments, a method can include data pre-processing (e.g., for the collected audio data, contextual data, etc.). Pre-processing can include any one or more of: extracting features (e.g., audio features for use in generating outputs; contextual features, such as the identified acoustic source at which the user is directing attention, based on earpiece motion sensor data tracking head movement and head orientation of the user; contextual features extracted from contextual dataset; etc.), performing pattern recognition on data (e.g., for acoustic source parameter determination, such as for classifying acoustic sources into different types; for identifying contextual environments; etc.), fusing data from multiple sources (e.g., multiple audio sensors; background and foreground audio signals; recombining audio based on user feedback, settings; etc.), data association (e.g., associating audio data and/or related parameters with user accounts at a remote computing system for facilitating improved and personalized audio recombination; etc.), combination of values (e.g., averaging values, etc.), compression, conversion (e.g., digital-to-analog conversion, analog-to-digital conversion), wave modulation, normalization, updating, ranking, weighting, validating, filtering (e.g., for baseline correction, data cropping, etc.), noise reduction, smoothing, filling (e.g., gap filling), aligning, model fitting, binning, windowing, clipping, transformations (e.g., Fourier transformations such as fast Fourier transformations, etc.), mathematical operations, clustering, and/or other suitable processing operations. However, pre-processing data and/or collecting audio datasets can be performed in any suitable manner.

In some embodiments, a method can additionally or alternatively include collecting a contextual dataset (e.g., at any suitable components of the system). For example, this can function to collect data usable improving determination of acoustic source parameters, recombination parameters, and/or other suitable data for facilitating improved audio separation and recombination. Contextual datasets may be indicative of the contextual environment associated with one or more acoustic sources and/or corresponding audio, but can additionally or alternatively describe any suitable related aspects. Contextual datasets can include any one or more of: supplementary sensor data (e.g., sampled at supplementary sensors of an earpiece; a user mobile device; and/or other suitable components; etc.), user data (e.g., user feedback, such as including user ratings of recombined audio quality, user preferences and/or settings, user inputs at the earpiece, at an auxiliary system, at a user device in communication with the earpiece, auxiliary system, and/or other suitable component; user device data describing user devices; etc.).

Supplementary sensor data can include data collected from one or more of: audio sensors, motion sensors (e.g., accelerators, gyroscopes, magnetometers, etc.), optical sensors (e.g., cameras, light sensors, etc.), location sensors (e.g., GPS sensors, etc.), biometric sensors (e.g., heart rate sensors, fingerprint sensors, bio-impedance sensors, etc.), pressure sensors, temperature sensors, volatile compound sensors, weight sensors, humidity sensors, depth sensors, flow sensors, power sensors (e.g., Hall effect sensors), wireless signal sensors (e.g., radiofrequency sensors, WiFi sensors, Bluetooth sensors, etc.), and/or or any other suitable sensors. However, contextual datasets can be collected and used in any suitable manner.

In some embodiments, a method includes determining acoustic source parameters based on the audio dataset, which can function to determine parameters characterizing acoustic sources corresponding to collected audio. The acoustic source parameters may be used as inputs in determining recombination parameters for facilitating subsequent audio recombination, but can be used as inputs for any suitable portions of a method. Acoustic source parameters can include one or more of: source type (e.g., human voice; animal; vehicle; music; machine; appliance; utensil; tool; classifications associated with any suitable objects; etc.), identity (e.g., identity of a voice, such as voice of user, likeliness of the voice being from an individual known by the user; intimacy, intensity, and/or other indicators of the strength of the relationship between the user and the individual, such as based on frequency and/or time of day associated with interactions between the user and the individual given the individual's identity, based on social signals such as user responsiveness to the individual's voice, anonymous word analysis of conversations between the user and the individual, based on the proportion of time that a user is actively listening to a speaker when the user is within a threshold distance such as within listening distance of the speaker, and/or based on any other suitable data, any of which can be used for determining identity parameters and/or other suitable acoustic source parameters; indications of whether the voice is from an individual in communication with the user; specific identities for other source types, such as a user's pet; etc.), location (e.g., angle; distance; coordinates; direction of audio relative to user's orientation; location of acoustic sources relative to user; location of acoustic sources relative to components of the contextual environment, such as relative beacons proximal the user; etc.); novelty (e.g., describing informativeness of an acoustic source, such as degree to which the audio informs the contextual environment and/or is relevant to the user; correlated with temporal indicators corresponding to origination of audio from different sources; etc.). In a specific example, in some embodiments, a method can include determining acoustic source type classifications and identities of a first voice of a user (e.g., wearing one or more earpieces), a second voice of an individual (e.g., an individual not wearing a hearing aid system; a second user wearing a second hearing aid system, where the first user is wearing a first hearing aid system; etc.) conversing with the first user, vehicular operation audio from an automobile, and music originating from the automobile; locations of the second voice of the individual, the vehicular operation audio, and the music relative to the user (e.g., relative distance, angle, etc.); novelty scores associated with each source (e.g., a high novelty score for the individual who is currently speaking and identified to be an individual with whom the first user has historically communicated with frequently; a low novelty score for the vehicular operation audio which has been identified as engine noise; etc.); and contextual environment classifications of a conversation between two individuals, listening to music, and driving in a vehicle. In another specific example, acoustic source parameters can be determined for background traffic noise outside the building in which the user is residing, but acoustic sources can include any suitable groupings and/or point sources of audio. Acoustic source parameters may be dynamically updatable (e.g., a moving estimate dynamically determined based on and in response to collecting updated audio data such as new frames and/or contextual data; etc.), but can additionally or alternatively be static (e.g., for acoustic sources with a low novelty score indicating an acoustic source of lower importance; for acoustic sources with a lower rate of variance in time, such as for a given contextual environment; for specific types of acoustic source parameters, such as for estimates of importance, relevance, user interest, and/or other indicators of novelty; etc.).

Determining acoustic source parameters may be based on one or more audio datasets. For example, a method can include classifying audio based on audio features extracted from corresponding audio data. A specific example can include classifying audio as corresponding to a vehicular siren based on pattern matching audio features from the audio data to reference audio features corresponding to vehicular sirens; determining a high novelty score based on the siren classification; and using the siren classification to determine contextual environment parameters such as indicating a potentially dangerous environment (e.g., where hearing aid system operation parameters, such as optimization parameters for accuracy and/or latency can be modified based on contextual environment parameters and/or other suitable data; etc.). In another example, audio volume features extracted from the audio data can be used in determining source location (e.g., distance relative the user) and/or other suitable parameters. In another example, a method can include determining audio covariances between spatial directions (e.g., based on mapping microphones into a spatial layout and pre-combining; etc.) associated with directional microphones of one or more earpieces; and processing the audio data with the audio covariances to facilitate acoustic source separation and characterization. Audio data can be decomposed into corresponding frequency components, where the frequency components can be characterized (e.g., tagged, etc.) by determined acoustic source parameters. In another example, a method can include determining acoustic source parameters based on a user orientation derived from audio data from a set of directional microphones (e.g., and/or derived from motion sensor data, other contextual data, contextual audio data, and/or other suitable data; etc.).

Additionally or alternatively, a method can include determining acoustic source parameters based on contextual audio data (e.g., derived from audio sensors distinct from the audio sensors of one or more earpieces worn by the user; etc.). In an example, elements of a method can be based on audio data from a plurality of hearing aid systems (e.g., worn by a plurality of users; etc.). In a specific example, a method can include detecting a proximity between a first and second hearing aid system below a threshold proximity (e.g., based on location data collected at location sensors of the hearing aid system, of user devices; based on comparing audio data from the first and the second hearing aid systems; etc.); transmitting contextual audio data from the second hearing aid system to the first hearing aid system (e.g., an auxiliary system of the first hearing aid system); and determining acoustic source parameters based on audio data from the first hearing aid system and contextual audio data from the second hearing aid system. In another example, elements of a method can be based on contextual audio collected at audio sensors of user devices (e.g., smartphone, laptop, tablet, smart watch, smart glasses, virtual reality devices, augmented reality devices, vehicles, aerial devices such as drones, medical devices, etc.). In a specific example, a method can include triangulating locations of acoustic sources based on contextual audio data. However, determining acoustic source parameters based on audio data and/or contextual audio data can be performed in any suitable manner.

In a variation, in some embodiments, elements of a method can be based on contextual datasets. In an example, a method can include determining source locations based on location data (e.g., GPS data; etc.) sampled at location sensors of the hearing aid system, of user devices, and/or other suitable components (e.g., beacons). In examples, determining source locations (and/or other suitable acoustic source parameters and/or other parameters; etc.) can be based on signal data (e.g., signal quality; received signal strength indicators; Wi-Fi positioning system parameters; signal angle of arrival with directional sensors; signal time of arrival; etc.); visual markers (e.g., captured by collected optical data; usable in determining relative location of acoustic sources to the user based on optical data captured by the hearing aid system, user device, and/or other components; visual markers that can additionally or alternatively facilitate determination of source type, identity, contextual environment, novelty, and/or other suitable parameters; etc.); radar data; lidar data; sonar data, audio data, temperature data; inertial measurements; magnetic positioning, and/or other suitable data. In a specific example, a method can include generating a spatial map including locations of acoustic sources and the user within the spatial map.

In another example, a method can include determining a novelty score based on temporal indicators (e.g., recency) for acoustic introduction of a new acoustic source to the audio environment (e.g., as indicated by timestamps collected for and associated with audio data corresponding to the acoustic source; etc.); identifying the type and/or identity of the new acoustic source; and/or performing any suitable operations in response to detection of a new acoustic source. In a specific example, determining novelty (e.g., a novelty score; a different novelty metric; etc.) can be based on measuring the recency of the occurrence of an acoustic source (e.g., the observance of the acoustic source; the introduction of the acoustic source; etc.) and/or the rarity or commonness (e.g., general frequency; frequency given a contextual environment; frequency given the time of day; etc.) of the occurrence of the acoustic source. In examples, determining a novelty score can be based on: motion sensor data (e.g., indicating attention of wearer to the acoustic source, such as through determining head movements and/or orientation relative the acoustic source; etc.), signal data (e.g., known wireless signatures, including WiFi, Bluetooth, and radiofrequency signatures, where the signatures can be associated with identified devices, individuals, and/or contextual environments, and where the signal data can additionally or alternatively facilitate identification of the type and/or identity of the acoustic source; etc.), and/or any other suitable data.

In another example, a method can include determining contextual environment parameters and/or other suitable parameters based on a user schedule (e.g., indicated by a scheduling application executing on a user device; manually input by the user; automatically inferred based on historical data for the user; etc.).

In another example, a method can include determining acoustic source parameters based on historic contextual data (and/or audio data). For example, a method can include mapping collected audio data to historic, characterized acoustic sources (e.g., recently characterized by the hearing aid system), such as by comparing current contextual data to historic contextual data (e.g., comparing WiFi, Bluetooth, radiofrequency, and/or other signal signatures; comparing motion sensor data tracking user movements and orientations to historic motion sensor data; using location data to identify a current location of the user matching a previously visited location associated with a previous audio session, where acoustic source parameters for the previous audio session can be used and/or updated for the current audio session; comparing current frequency of communications with a human acoustic source to historic frequency of communications with different human acoustic sources to identify the human acoustic source; etc.). In a specific example, a method can include identifying an acoustic source type and identity; retrieving a historic novelty score for the acoustic source type and identity (e.g., determined based on historical attention of the user directed at the acoustic source as indicated by historical motion sensor data; etc.); and updating the historic novelty score based on current contextual data (e.g., current motion sensor data; updated social network data associated with the user and the acoustic source; etc.) and/or audio data.

In another example, user feedback can be collected (e.g., at an interface of the hearing aid system; at a smartphone application; etc.) and be indicative of any suitable acoustic source parameters and/or other suitable parameters. However, determining acoustic source parameters can be based on any suitable combination of data in any suitable manner.

In variations, a method can include applying (e.g., generating, training, storing, retrieving, executing, etc.) an acoustic source model for determining acoustic source parameters. Acoustic source models and/or other suitable models (e.g., recombination models, other models associated with any suitable portions of a method, etc.) can include any one or more of: probabilistic properties, heuristic properties, deterministic properties, and/or any other suitable properties. Further, in some embodiments, models and/or other suitable components of a method can employ machine learning approaches including any one or more of: neural network models, supervised learning, unsupervised learning, semi-supervised learning, reinforcement learning, regression, an instance-based method, a regularization method, a decision tree learning method, a Bayesian method, a kernel method, a clustering method, an associated rule learning algorithm, deep learning algorithms, a dimensionality reduction method, an ensemble method, and/or any suitable form of machine learning algorithm. In an example, in some embodiments, a method can include applying a neural network model (e.g., a recurrent neural network, a convolutional neural network, etc.) for determining acoustic source parameters, where raw audio data (e.g., raw audio waveforms), processed audio data (e.g., extracted audio features), contextual data (e.g., supplementary sensor data, user data, etc.), and/or other suitable data can be used in the neural input layer and/or in adjusting model parameters of the neural network model. Applying acoustic source models, other models, and/or performing any other suitable processes associated with a method according to some embodiments can be performed by one or more: earpieces, auxiliary systems, and/or other suitable components.

In some embodiments, each model can be run or updated: once; at a predetermined frequency; every time an instance of an embodiment of the method and/or subprocess is performed; every time a trigger condition is satisfied (e.g., detection of audio activity; detecting of a new acoustic source; detection of parameters satisfying a condition, such as unexpected acoustic source parameters, recombination parameters, user feedback, and/or other unexpected data values; etc.), and/or at any other suitable time and frequency. Each model can be validated, verified, reinforced, calibrated, and/or otherwise updated (e.g., at a remote computing system; at an earpiece; at a auxiliary system; etc.) based on newly received, up-to-date data; historical data and/or be updated based on any other suitable data (e.g., audio data and/or contextual data associated with a plurality of hearing aid systems, users, acoustic sources, contextual environments, etc.). The models can be universally applicable (e.g., the same models used across users, hearing aid systems, etc.), specific to users (e.g., tailored to a user's specific hearing condition; tailored to a user's feedback, preferences, and/or other user data; contextual environments associated with the user; acoustic sources associated with the user; etc.), specific to location, contextual environment, source type, source identity, temporal indicators (e.g., corresponding to common noises experienced at specific times; etc.), user devices, hearing aid systems (e.g., using different models requiring different computational processing power based on the type of earpiece and/or auxiliary system and/or associated components; etc.), and/or other suitable components. The models can be differently applied based on different contextual situations and/or recombination-related conditions (e.g., in response to detecting recombination-related faults, omitting usage of an acoustic source model and/or other suitable models, and operating in a default mode of voice amplification; applying different models in response to user feedback, such as applying an accuracy-focused model in response to receiving user feedback indicating low intelligibility; etc.). Additionally or alternatively, models described herein can be configured in any suitable manner. However, determining acoustic source parameters can be performed in any suitable manner.

In some embodiments, a method includes providing recombined audio to the user based on the acoustic source parameters, which can function to generate and recombine foreground and background audio signals (and/or other suitable audio data), such as based on acoustic source parameters, user data (e.g., user feedback, user settings), automatic environmental cues, and/or other suitable data, for enhancing and/or personalizing audio provided to the user. Providing recombined audio may include recombining a foreground audio signal dataset (e.g., including audio of greatest interest to the user, etc.) and a background audio signal dataset (e.g., including audio to provide context, etc.). Additionally or alternatively, any suitable number and/or type of categories of audio data can be used for separation and recombination. Parameters informing recombination (e.g., categorizations of foreground versus background; estimates of a foreground and background gradient; thresholds defining the degree to which background audio and/or foreground audio is included in the recombined audio;

optimization parameters; etc.) may be dynamically updatable (e.g., continuous updating of a moving average; updated as acoustic source parameters are updated), which can facilitate smooth transitions between old and new attention centers (e.g., conversation groups, contextual environments, etc.); but the recombination-related parameters can additionally or alternatively be static (e.g., a static first subset of recombination-related parameters; a dynamic second subset of recombination-related parameters; etc.).

In some embodiments, a method can additionally or alternatively include modifying the foreground and/or background audio signals (and/or other suitable recombination-related audio signals) to facilitate recombination into enhanced audio. In examples, a method can include applying filters for generating natural-sounding audio (e.g., based on statistical distributions of voice and/or other audio types; etc.); removing and/or reducing the effect of noise artifacts (e.g., changes in signal and quality), such as after filtering; modifying signal features (e.g., cadence, intonation, phonemes, etc.); modifying audio-related parameters (e.g., resolution, bit rate, bit depth, sampling rate, compression, etc.), such as based on historic parameters determined for the acoustic source in order to accordingly enhance, remove, and/or otherwise modify audio corresponding to the acoustic source; and/or other suitable processes for facilitating recombination. In variations, a method can include applying an audio enhancement model and/or other recombination models (e.g., using any suitable analogous approaches described herein with respect to models; deep learning generative models and/or other suitable models; etc.). For example, a method can include applying an audio recombination neural network model (and/or other suitable statistical techniques, such as those described herein) for generating novel audio waveforms (e.g., based on the original audio, acoustic source parameters, recombination parameters, etc.), which can function to enhance intelligibility and aesthetic comfort without losing realism.

Providing recombined audio (e.g., including recombining foreground and background audio signals; modifying such signals; determining the degree to which background audio signals will be included in the recombined audio; etc.) may be performed according to recombination parameters. In an example, a method can include fractional filtering based on foreground parameters and/or background parameters, but any suitable filters can be generated (e.g., at an auxiliary system for transmission to an earpiece to apply to audio data, etc.) for facilitating recombination. In a specific example, a method can include generating a fractional filter of the frequencies at each temporal indicator based on the foreground parameters and/or background parameters associated with (e.g., assigned to, tagged to, determined for, etc.) the frequencies (e.g., generating a fractional filter for including audio frequencies corresponding to audio labeled as foreground, and for excluding audio frequencies corresponding to audio labeled as background; etc.). In another example, audio enhancement can be correlated with foreground score and/or background score (e.g., providing greater enhancement of audio signals with higher foreground scores; providing specific types of audio signal modification based on foreground and/or background score; etc.). However, providing recombined audio according to recombination parameters can be performed in any suitable manner.

In some embodiments, a method includes determining recombination parameters (e.g., parameters informing the audio recombination process; outputted parameters based on the acoustic source parameters; etc.). Recombination parameters may include foreground parameters and/or background parameters. Foreground parameters and/or background parameters can include one or more of: classifications (e.g., as foreground or background, etc.), scores (e.g., indicating degree of foreground and/or background, etc.), values along a spectrum, tags (e.g., for tagging audio data such as frequency components; for acoustic sources; for contextual environment components; etc.), and/or other suitable recombination-related parameters facilitating generation of foreground and/or background audio signals for recombination. Additionally or alternatively, recombination parameters can include undetermined classifications (e.g., where foreground or background is to be determined at a later time period from updated audio data and/or contextual data; etc.), preliminary parameters (e.g., preliminary foreground and/or background parameters to be updated based on additional data; etc.), user preferences (e.g., in relation to preferred characteristics of recombined audio to be played back to the user), and/or any other suitable recombination parameters. Recombination parameters may be dynamically updatable (e.g., dynamically updatable foreground or background classifications based on updated acoustic source parameters; etc.), but can additionally or alternatively be static (e.g., for audio and/or acoustic sources tagged with a background score below a threshold score; etc.). Recombination parameters (and/or other suitable data) can be stored and/or retrieved at any suitable time and frequency (e.g., for generating a database of historic recombination parameters and/or other suitable parameters for a plurality of users in generating personalized user profiles to user with models described herein; etc.).

Determining recombination parameters may be based on acoustic source parameters. In variations, elements of a method can be based on one or more of: source type (e.g., assigning voices to foreground and non-voices to background; adjusting foreground and background scores based on the number and/or types of acoustic sources detected, such as dynamically adjusting a background score based on frequency overlap with the estimated foreground; etc.); source identity (e.g., classifying audio as foreground in response to the audio being classified as a voice and corresponding to an identity of an individual with a social connection score to the user exceeding a threshold; classifying acoustic sources as background in response to social connection scores below the threshold; ranking individuals along a foreground to background spectrum based on relevance to user; correlating foreground scores with relationship intimacy scores describing the strength of a relationship between a user and one or more other individuals who are acoustic sources; etc.); location (e.g., classifying acoustic sources as foreground based on corresponding locations within a threshold distance from the user; correlating foreground scores to proximity to user; adjusting foreground and/or background parameters based on audio directionality relative the user's head orientation; etc.); novelty (e.g., correlating foreground scores with novelty scores; mapping new acoustic sources, changes in audio satisfying conditions, and/or more recent audio to foreground classifications; determining a foreground classification for an acoustic source with rare occurrence frequency; determining user interest scores for audio data and/or acoustic sources based on novelty scores, such as determining higher user interest scores for acoustic sources to which a user more frequently responds and/or directs attention to; etc.); contextual environment (e.g., adjusting foreground and/or background parameters based on historical user feedback to historical recombined audio provided in historic audio sessions for the contextual environment, such as single conversations, multiparty conversations, presentations, ambient conversations, music, and/or other suitable activities; determining recombination parameters based on reference recombination parameters determined for other users in historic audio sessions sharing the same contextual environment, such as at a cafe, home, social event, driving a car, walking, and/or other suitable activities; etc.); and/or any other suitable data. In examples, determining recombination parameters can be based on an importance metric (e.g., an importance score, an importance classification, etc.) associated with one or more acoustic sources. In a specific example, elements of a method can be based on a class importance metric (e.g., an importance metric per acoustic source type; importance metric per acoustic source type given a particular contextual environment; etc.), which can be based on one or more of: the probability that an acoustic source (e.g., audio activity from the acoustic source, presence of an acoustic source, etc.) will result in pausing of speech of the logical conversation; directing of attention from the user to the acoustic source (e.g., based on tracking head movement); and/or any other suitable criteria. In another specific example, elements of a method can be based on net importance metrics associated with acoustic sources, such as through: determining, for each acoustic source, a net importance metric (e.g., indicating likelihood of the acoustic source to be foreground over other acoustic sources; etc.) based on summarized features (e.g., derived from audio data and contextual audio data) including acoustic source type, novelty, intimacy, class importance, location, contextual environment, and/or other suitable acoustic source parameters; and determining recombination parameters (e.g., foreground parameters, background parameters) based on the net importance metrics and current audio data (e.g., where the net importance metrics inform the recombination analysis of the current audio data, etc.).

In another variation, elements of a method can be based on acoustic source overlap (e.g., first audio data from a first acoustic source temporally overlapping with second audio data from a second acoustic source). For example, a method can include grouping conversations based on acoustic source overlap (and/or other suitable conversational cadence parameters; etc.). In a specific example, acoustic sources (e.g., identified as voices) that overlap can be determined to not be part of the same conversational group (e.g., where audio data from acoustic sources in a conversational group with the user can be further processed to determine identity; where audio data from acoustic sources not in the conversational group can be determined as background; etc.). In another specific example, acoustic sources that overlap with audio originating from the user (and/or from a conversational group including the user), such as for a time period exceeding a threshold time period, can correlate with background noise and/or of lower interest to the user (e.g., unrelated to the user's conversation), where such acoustic sources can be classified as background. In another specific example, acoustic sources originating before and/or after a user speaks (e.g., within a threshold time period) can be more likely to be part of the same conversational group (e.g., where a higher foreground score can be assigned to such acoustic sources; etc.). Acoustic source overlap parameters can additionally or alternatively be processed with other acoustic source parameters (e.g., where the acoustic source overlap parameters along with a plurality of other parameters dynamically affect foreground and/or background scores for detected acoustic sources; etc.).

However, determining recombination parameters can be based on any suitable combination of data (e.g., audio data, contextual data, etc.) in any suitable manner. For example, in some embodiments, a method can include determining foreground parameters and background parameters based on favoring (e.g., increased likelihood of foreground classification; increased foreground score; etc.) voice over non-voice (e.g., and/or otherwise ranking source types); sources at which the user is directing attention over sources not associated with user attention (e.g., and/or otherwise ranking novelty); conversational partner voices over non-conversational partner voices (e.g., and/or otherwise ranking identity and/or contextual environment); loud sources over quiet sources (e.g. and/or otherwise ranking variables associated with location; etc.); novelty over non-novelty (e.g., historical interest over non-historical interest and avoidance; etc.); and/or on any suitable prioritization of acoustic source parameters and/or other suitable data.

In variations, a method can include applying a recombination parameter model (e.g., leveraging any suitable model-related approaches described herein) for determining recombination parameters. For example, recombination parameter models can be trained, executed, updated, and/or otherwise applied with feature types including the types of acoustic source parameters and/or any other suitable data types, such as based on historic acoustic source parameters collected (e.g., at a remote computing system) for different users, hearing aid systems, acoustic source parameter values (e.g., different audio types, identities, locations, novelties, contextual environments, etc.). In another example, recombination-related faults (e.g., faulty classifications of foreground and background; enhancing audio from acoustic sources outside of the conversational group including the user; etc.) can be handled by using different recombination parameter models (e.g., a model incorporating acoustic source overlap parameters and/or other additional parameters; etc.) and/or handled in any suitable manner. However, applying recombination parameter models and other elements of a method can be performed in any suitable manner.

In a variation, in some embodiments, elements of a method can be based on a distinction threshold (e.g., for dividing foreground and background audio; for layering of background audio; for amplification or de-amplification of foreground and/or background audio; etc.), which can be associated with any one or more of: scores (e.g., ranging from scores indicating clean and intelligible to inclusive and noisy; etc.), modes (e.g., indicating degrees of filtering for a strict mode, clean mode, intelligible mode, inclusive mode, contextual mode, noisy mode, etc.), and/or any other suitable parameters for modification of the distinction threshold. Recombination can be based on a baseline distinction threshold (e.g., a default fractional filter), on adjusted distinction thresholds, and/or on any suitable distinction thresholds. For example, elements of a method can include layering in a percentage of background audio (e.g., 5¬60%) based on contextual environment (e.g., road noise, conference room, presentation setting, professional setting, recreational setting, other suitable environments; using a stricter filter for a loud, multi-party conversation environment; using an inclusive filter for a single voice, quiet room environment; where such contextual environments can be tagged with suitable foreground and/or background parameters informing the selection of the distinction threshold; etc.); novelty (e.g., including background audio with a high novelty score; selecting a stricter distinction threshold for intelligibility in response to detecting the user directing attention to a single acoustic source in a noisy environment; selecting a more inclusive distinction threshold in response to detecting the user directing attention towards a variety of sources in the environment, such as when a user is looking around a room; etc.); and/or other suitable acoustic source parameters, and/or other suitable data. In examples, determining and applying one or more distinction thresholds can be based on user data (e.g., tuning settings provided by users for dynamically adjusting the distinction threshold, such as an interfaces of the earpiece and/or auxiliary system; historic user feedback associated with the distinction threshold, such as historic tuning settings to adjust a personalized distinction threshold baseline for a user, to adjust the degree of distinction threshold adjustment in response to user inputs; etc.); audio professional data (e.g., tuning settings provided by audio professionals; etc.); and/or other suitable data. In a specific example, elements of a method can be based on a medical assessment of a user's physiological capability to separate signal from noise (e.g., determining user settings for tuning and/or determining other parameters for audio recombination based on contextual data collected from a QuickSIN test by an audiologist, collected from other medical tests, medical records, inputs by a user, and/or other suitable data sources; etc.). Additionally or alternatively, providing recombined audio based on a distinction threshold, or other elements of a method, can be performed in any suitable manner.

The various embodiments that have been described with reference to the accompanying drawings, which form a part hereof, and which show, by way of illustration, specific examples of practicing the embodiments. This specification may, however, be embodied in many different forms and should not be construed as limited to the embodiments set forth herein; rather, these embodiments are provided so that this specification will be thorough and complete, and will fully convey the scope of the invention to those skilled in the art. Among other things, this specification may be embodied as methods or devices. Accordingly, any of the various embodiments herein may take the form of an entirely hardware embodiment, an entirely software embodiment wherein the software is stored in a computer readable medium for execution by computer hardware, or an embodiment combining software and hardware aspects. The following specification is, therefore, not to be taken in a limiting sense.

The foregoing specification is to be understood as being in every respect illustrative and exemplary, but not restrictive, and the scope of the invention disclosed herein is not to be determined from the specification, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention.

What is claimed is:

1. A method of enhancing audio for at least one earpiece of a user comprising:

receiving, at an auxiliary processing device, audio data corresponding to audio sensed at the at least one earpiece;

receiving, at the auxiliary processing device, additional data, including non-audio data, relevant to processing to enhance the audio sensed at the at least one earpiece;

using the received audio data to identify a plurality of respective portions of the audio data as corresponding to a plurality of respective separate audio sources;

using the received audio data and the additional data to estimate relevancy of each respective separate audio source to the user, wherein the additional data used to estimate relevancy comprises data regarding at least one of the following: a magnitude of change in speech of the user, amount of immediately preceding time that an audio source of the respective separate audio sources has been making sound in a vicinity of the user, and a fraction of an historical time period that an audio source of the respective separate audio sources has been making sound in a vicinity of the user;

using the estimated relevancy to determine volume weights for each respective separate audio source; and using the volume weights to determine and send enhancement data to the at least one earpiece for enhancing audio played for the user at the at least one earpiece.

2. The method of claim 1 further comprising:

using the additional data to determine one or more contextual parameters potentially applicable to determining the relevance of the respective audio sources; and using one or more of the determined contextual parameters to determine relevancy of one or more of the respective separate audio sources.

3. The method of claim 1 wherein using the received audio data to compute audio source parameters for each respective separate audio source comprises also using the additional data to compute audio source parameters.

4. The method of claim 1 wherein using the received audio data to identify a plurality of respective portions of the audio data as corresponding to a plurality of respective separate audio sources comprises using a machine-learning algorithm.

5. The method of claim 4 wherein the machine-learning algorithm is trained at a remote computing system that communicates with the auxiliary processing device.

6. The method of claim 1 wherein using the received audio data to compute audio source parameters for each respective separate audio source comprises using a machine-learning algorithm.

7. The method of claim 1 wherein using the received audio data and the additional data to estimate relevancy of each audio source to the user comprises using a machine-learning algorithm.

8. The method of claim 7 wherein the machine-learning algorithm is trained at a remote computing system that communicates with the auxiliary processing device.

9. The method of claim 1 wherein the enhancement data comprises enhanced audio.

10. The method of claim 1 wherein the enhancement data comprises filter updates for filters to be applied by the at least one earpiece to enhance the sensed audio data.

11. The method of claim 1, wherein the additional data used to estimate relevancy comprises data regarding a magnitude of change in speech of the user.

12. The method of claim 1, wherein the additional data used to estimate relevancy comprises data regarding an amount of immediately preceding time that an audio source of the respective separate audio sources has been making sound in a vicinity of the user.

13. The method of claim 1, wherein the additional data used to estimate relevancy comprises data regarding a fraction of an historical time period that an audio source of the respective separate audio sources has been making sound in a vicinity of the user.

14. A hearing aid system comprising:

at least one earpiece configured to sense audio and to transmit audio data corresponding to the sensed audio; and an auxiliary processing device configured to receive the audio data from the at least one earpiece; to receive additional data, including non-audio data, relevant to processing to enhance the audio sensed at the at least one earpiece; and to perform processing comprising:

using at least the received audio data to identify a plurality of respective portions of the audio data as corresponding to a plurality of respective separate audio sources;

using at least the received audio data to compute audio source parameters for each respective separate audio source;

using the received audio data and at least a portion of the additional data to estimate relevancy of each respective separate audio source to the user, wherein the additional data used to estimate relevancy comprises data regarding one or more of the following: a magnitude of change in speech of the user, amount of immediately preceding time that an audio source of the respective separate audio sources has been making sound in a vicinity of the user, and a fraction of an historical time period that an audio source of the respective separate audio sources has been making sound in a vicinity of the user;

using the estimated relevancy to determine volume weights for each respective separate audio source; and using the volume weights to determine enhancement data to send to the at least one earpiece for enhancing audio played for the user at the at least one earpiece.

15. The hearing aid system of claim 14 wherein the auxiliary processing device is further configured to perform processing comprising:

using the non-audio data to determine one or more contextual parameters potentially applicable to determining the relevance of the respective audio sources; and using one or more of the determined contextual parameters to determine relevancy of at least one of the respective separate audio sources.

16. The hearing aid system of claim 14 wherein the auxiliary processing device is configured to use the additional data to compute the audio source parameters.

17. The hearing aid system of claim 14 wherein the enhancement data comprises enhanced audio.

18. The hearing aid system of claim 14 wherein the enhancement data comprises filter updates for filters to be applied by the at least one earpiece to enhance the sensed audio data.

19. The hearing aid system of claim 14, wherein the additional data used to estimate relevancy comprises data regarding a magnitude of change in speech of the user.

20. The hearing aid system of claim 14, wherein the additional data used to estimate relevancy comprises data regarding an amount of immediately preceding time that an audio source of the respective separate audio sources has been making sound in a vicinity of the user.

21. The hearing aid system of claim 14, wherein the additional data used to estimate relevancy comprises data regarding a fraction of an historical time period that an audio source of the respective separate audio sources has been making sound in a vicinity of the user.

22. A computer program product comprising a non-transitory computer readable medium storing executable instruction code that, when executed by a processor, performs processing comprising:

using audio data corresponding to audio sensed by at least one earpiece to identify a plurality of respective portions of the audio data as corresponding to a plurality of respective separate audio sources;

using the audio data to compute audio source parameters for each respective separate audio source;

using the audio data and additional data, including non-audio data, to estimate relevancy of each respective separate audio source to the user, wherein the additional data used to estimate relevancy comprises data regarding at least one of the following: a magnitude of change in speech of the user, amount of immediately preceding time that an audio source of the respective separate audio sources has been making sound in a vicinity of the user, and a fraction of an historical time period that an audio source of the respective separate audio sources has been making sound in a vicinity of the user;

using the estimated relevancy to determine volume weights for each respective separate audio source; and using the volume weights to determine enhancement data to send to the at least one earpiece for enhancing audio played for the user at the at least one earpiece.

23. The computer program product of claim 22 wherein the processing further comprises:

using the additional data to determine one or more contextual parameters potentially applicable to determining the relevance of the respective audio sources; and using one or more of the determined contextual parameters to determine relevancy of at least one of the respective separate audio sources.

24. The computer program product of claim 22 wherein using the received audio data to compute audio source parameters for each respective separate audio source comprises also using the additional data to compute audio source parameters.

25. The computer program product of claim 22 wherein the enhancement data comprises enhanced audio.

26. The computer program product of claim 22 wherein the enhancement data comprises filter updates for filters to be applied by the at least one earpiece to enhance the sensed audio data.

27. The computer program product of claim 22, wherein the additional data used to estimate relevancy comprises data regarding a magnitude of change in speech of the user.

28. The computer program product of claim 22, wherein the additional data used to estimate relevancy comprises data regarding an amount of immediately preceding time that an audio source of the respective separate audio sources has been making sound in a vicinity of the user.

29. The computer program product of claim 22, wherein the additional data used to estimate relevancy comprises data regarding a fraction of an historical time period that an audio source of the respective separate audio sources has been making sound in a vicinity of the user.

* * * * *